US006845570B2

(12) United States Patent
Paterson

(10) Patent No.: US 6,845,570 B2
(45) Date of Patent: Jan. 25, 2005

(54) PAVEMENT DRYER

(75) Inventor: Robert Paterson, South Reading, VT (US)

(73) Assignee: WCCP, LLC, South Hero, VT (US)

( * ) Notice: Subject to any disclaimer, the term of this patent is extended or adjusted under 35 U.S.C. 154(b) by 0 days.

(21) Appl. No.: 10/659,895

(22) Filed: Sep. 10, 2003

(65) Prior Publication Data

US 2004/0045122 A1 Mar. 11, 2004

Related U.S. Application Data

(60) Provisional application No. 60/410,213, filed on Sep. 11, 2002.

(51) Int. Cl.[7] ..... F26B 19/00

(52) U.S. Cl. ..... 34/226; 34/90; 34/227; 34/229

(58) Field of Search ..... 34/218, 85, 90, 34/227, 229, 226

(56) References Cited

U.S. PATENT DOCUMENTS

| | | | | | |
|---|---|---|---|---|---|
| 3,455,041 | A | * | 7/1969 | Roberts | 37/195 |
| 4,133,072 | A | * | 1/1979 | Face, Jr. | 15/353 |
| 4,226,034 | A | | 10/1980 | Benjamin et al. | 37/12 |
| 4,571,849 | A | * | 2/1986 | Gardner et al. | 34/79 |
| 4,779,303 | A | | 10/1988 | Duthie et al. | 15/326 |
| 4,827,559 | A | | 5/1989 | Norland | 15/322 |
| 5,460,657 | A | | 10/1995 | Ally | 134/20 |
| 5,533,577 | A | * | 7/1996 | Jucker | 172/51 |
| 5,561,921 | A | * | 10/1996 | Vanderlinden | 37/227 |
| 6,049,943 | A | | 4/2000 | Carter | 15/340.3 |
| 6,189,179 | B1 | | 2/2001 | Baird | 15/364 |
| 6,298,578 | B1 | | 10/2001 | Frampton | 34/465 |

* cited by examiner

*Primary Examiner*—Ira S. Lazarus
*Assistant Examiner*—Kathryn S. O'Malley
(74) *Attorney, Agent, or Firm*—Michael J. Weins; Jeffrey E. Sempreban

(57) ABSTRACT

A pavement dryer has a pick-up assembly operating with a gas processing system. The pick-up assembly has an assembly frame mounted on wheels and connected to the gas processing system, and a nozzle that is maintained in close proximity to a paved surface. The gas processing system has a system frame mounted on wheels, a compressor, and a collection chamber. The compressor draws air from the nozzle through the collection chamber. Water entrained in the air flow is removed from the paved surface and settles in the collection chamber. The water may be separated by gas centrifuges. The nozzle has a nozzle lip positioned to provide a controlled gap with the paved surface. The size of the gap can preferably be adjusted, preferably by a movable damper. The nozzle has a trailing edge seal that forcibly engages the paved surface, and preferably also has end seals.

20 Claims, 12 Drawing Sheets

PAVEMENT DRYER

This application claims the benefit of Provisional Application 60/410,213 filed Sep. 11, 2002.

FIELD OF THE INVENTION

The present invention relates to a pavement dryer and, more particularly, to a pavement dryer which has particular utility for drying racetracks.

BACKGROUND OF THE INVENTION

Removal of liquids and debris from a paved surface is frequently required, typically to assure safe operation of motor vehicles on the surface. Various approaches have been employed for removing liquid and debris from paved surfaces. One approach has been to use hand-held nozzles similar to those found on a shop vacuum to assist in removal of the contaminants, such as taught in U.S. Pat. No. 4,226,034 for the removal of snow which might otherwise obstruct vehicle traffic over the paved surface.

For surfaces used in motor vehicle racing, the surface must not only be free of debris and other contaminants such as oil, but the surface must also be dry. Racing vehicles operate at high speeds and rely on traction between the tires of the vehicle and the track surface, as well as the skill of the operator, to maintain control of the vehicle during a race, so a dry track is imperative. An additional factor is the time required to dry the track, as a scheduled race may be delayed or even postponed if the time required to dry the track is excessive.

Classically, racetracks have been dried with truck-mounted jet turbines which serve as pavement dryers blowers that dry the track. This approach is time consuming and requires large quantities of fuel to operate the jet turbines. Recently, two patents have issued for inventions which are specifically directed to drying paved surfaces such as racetracks.

The first of these, U.S. Pat. No. 6,049,943, teaches a machine for removing water from outdoor surfaces, the machine having multiple drying units movably mounted to a frame and connected to a tank which resides on the frame. The tank has a storage section, for collecting water, and an air flow section connected to a suction fan. The drying units are arranged in two staggered rows, each drying unit having a roller and a suction housing. The roller has a foam tube which is compressed against the pavement to form one edge of an enclosed region, the remaining edges being formed by the suction housing. The suction housing includes an inlet into which water residing in the enclosed region is forced by suction, the water collecting in the housing and thereafter being pumped to the storage section of the tank. Any water absorbed by the foam tube is removed by a wringer and also drawn into the housing by suction. Water entrained in the suction air collects in the air flow section of the tank and is also pumped to the storage section. The device of the '943 patent is a complicated, multiple-component structure, and the use of foam tubes may make the device highly susceptible to wear.

U.S. Pat. No. 6,189,179 teaches a surface drying machine with a somewhat simpler structure. The machine uses squeegees to divert water from its path and a rotating brush in a first chamber to collect any remaining water and deposit the water into a drip pan. The water from the drip pan collects in a tank. A blower forces hot air into a second chamber to evaporate water not collected by the brush. In a preferred embodiment, two brushes are employed which are mounted in floating bearings to follow contours in the pavement surface. The use of a squeegee for diverting water limits the effectiveness of the device, as water diverted onto an adjacent portion of the pavement must be subsequently removed. Furthermore, the movement of water collected by the drip pan to the tank appears to be by gravity flow, limiting the use of the device to surfaces where the slope allows such flow.

Thus, there is a need for a device for rapidly removing water from a paved surface which avoids the deficiencies of the above referenced devices.

SUMMARY OF THE INVENTION

The present invention provides an apparatus for drying paved surfaces which, in some instances, also serves to clean the surfaces by picking up incidental debris. The device has particular utility in the maintenance of racetracks and hereinafter will be referred to as a pavement dryer. Pavement dryers of the present invention have a pick-up assembly which is well suited to be used in combination with a variety of gas processing systems.

The pick-up assembly serves for removing water and/or incidental debris, such as particulate material placed on oil spills to absorb the oil, from the paved surface. The pick-up assembly has utility when used with a variety of gas processing systems that serve to draw air through a collection chamber. The success of the pavement dryer depends on having the air rapidly drawn into the pick-up assembly as it advances across the pavement so as to draw the water and debris into the pick-up assembly. Furthermore, the velocity of the air passing through the pick-up assembly must be maintained sufficiently high so as to carry the liquids and debris through the pick-up assembly, thereby removing this material from the pavement and delivering it to the collection chamber of the gas processing system. The collection chamber in turn should be of sufficient size to reduce the velocity of air flowing therethrough to a rate that causes the liquid and debris carried by the air to "rain-out" and separate from the air flow.

The pick-up assembly has an assembly frame to which a nozzle is attached. The assembly frame is mounted on assembly wheels which are preferably adjustable with respect to the nozzle. Means for adjustably connecting the assembly frame to the gas processing system when the pick-up assembly is in service are provided. Typically, the pick-up assembly is mechanically connected to a system frame of the gas processing system by a linkage. Preferably, this linkage allows adjustment between the system frame and the assembly frame which aids in maintaining the nozzle at a constant separation with respect to the paved surface, even if the system frame pitches or rolls relative to the pick-up assembly due to irregularities in the paved surface. A preferred linkage employs a pair of parallel tow bars that attach to the assembly frame at about the level of the assembly wheels, in combination with a stabilizer bar that is parallel to and substantially above the pair of tow bars.

The assembly wheels preferably include a pair of wheels positioned ahead of the nozzle, and more preferably both a pair of wheels ahead of the nozzle and a pair of wheels behind the nozzle to stabilize the nozzle as the pick-up assembly traverses the paved surface. When two pairs of wheels are employed, at least one pair of the wheels should be mounted so that the wheels are free to rotate about an axis substantially normal to the paved surface, to facilitate moving the pick-up assembly along a curved path. It is also preferred that the two pairs of wheels be in close proximity to the nozzle so that the nozzle closely tracks the paved surface therebelow. Adjustment of the wheels relative to the nozzle can be readily provided by having the assembly wheels adjustably attached to the assembly frame so that the separation between the nozzle and the pavement can be adjusted.

The nozzle has an elongated nozzle body having a nozzle opening bounded by a nozzle leading edge, a nozzle trailing edge, and a pair of end caps. A trailing edge seal is resiliently mounted with respect to the nozzle trailing edge so as to be forcibly engaged with the pavement when the elongated nozzle body is in close proximity to the pavement. The trailing edge seal serves to close the space between the nozzle trailing edge and the paved surface. The trailing edge seal is preferably movably mounted to the nozzle body so as to allow the trailing edge seal to move upward and downward with respect to the nozzle trailing edge. It is further preferred for the trailing edge seal to be spring-loaded so as to be biased into engagement with the paved surface. The trailing edge seal is preferably formed of a flexible and resilient material to allow it to pass over small obstructions without damage, and may be inclined to further assist in passing over obstructions. It is preferred that end seals be provided to reduce air flow under the end caps. When employed, the end seals are positioned in close proximity to the paved surface or are forcibly engaged with the paved surface, in which case they can operate in a manner similar to the trailing edge seal.

A nozzle lip traverses the nozzle leading edge, where substantially all the flow into the nozzle occurs, and the nozzle lip serves to regulate the flow into the nozzle by providing a controlled gap between the pavement surface and the nozzle leading edge. The nozzle lip is preferably further configured to accelerate the flow as material enters the nozzle and to provide a smooth expanding surface for introduction of the material into the nozzle, thereby reducing turbulence and promoting the uplifting and passage of the water and debris through the nozzle.

Means for adjusting the size of the controlled gap are preferably provided to allow adjusting the air flow into the nozzle opening to optimize performance. Having the assembly wheels adjustably mounted to the assembly frame can provide one means for adjusting the size of the controlled gap. Preferably, a nozzle damper is provided to serve as the nozzle lip, in which case the nozzle damper is movably mounted with respect to the leading edge of the nozzle opening. While such a damper could be a slidable plate, it is preferred that a pivotable flap be employed; in either case, the surface of the flap or plate that faces the paved surface should be contoured to promote smooth flow of the air into the nozzle. When a damper is employed, movement of the nozzle damper serves to provide means for adjusting the size of the controlled gap between the nozzle leading edge and the pavement, either alone or in combination with adjustable mounting of the assembly wheels. The damper is preferably adjusted to be in close proximity to the pavement to increase the air flow rate across the nozzle leading edge of the nozzle body and provide a sufficient air velocity in the proximity of the paved surface to cause the air to strip the water and debris from the surface and transport it with the air through the nozzle, thereby enhancing the effectiveness of the nozzle body in collection of water and debris.

In one preferred embodiment, the nozzle damper has a forward edge region and a rear edge region, with the latter being pivotably mounted to the nozzle leading edge of the elongated nozzle body such that the nozzle damper acts as a flap. The nozzle damper is preferably configured to provide a convex surface facing the paved surface to promote the smooth flow of air under the nozzle damper. Additionally, the adjustment of the nozzle damper position can incorporate a degree of resiliently, in which case the convex surface facilitates the passage of debris beneath the intake damper by allowing the damper to rock, assisting debris to pass thereunder.

Preferably, a nozzle damper control system is provided which adjusts the position of the nozzle damper in response to the operating conditions to maintain the air flow through the nozzle at a sufficiently high velocity. This nozzle damper control system serves as part of the means for adjusting the size of the controlled gap. The nozzle damper control system can be manually controlled by an operator, in response to a visual assessment of the paved surface when the pavement dryer has passed thereover or, more preferably, in response to an indicator of the pressure in the nozzle. Alternatively, the nozzle damper control system could adjust the position of the nozzle damper automatically; again, it is preferred for the nozzle damper to be adjusted in response to the pressure experienced in the nozzle.

The gas processing system suitable for use in combination with one of the above described pick-up assemblies to provide a pavement dryer of the present invention has a system frame mounted on transporting wheels to allow the gas processing system to traverse the paved surface. The system frame can be either towed or self-propelled. A compressor and an engine to drive the compressor are mounted on the system frame. The compressor has a compressor intake port and a compressor exhaust port, and the compressor intake port communicates with a collection chamber which is mounted on the system frame. The collection chamber is in turn connected to the pick-up assembly as discussed below.

To enhance the operational efficiency of the gas processing system of the pavement dryer, it is preferred to employ one or more gas centrifuges which reside in the collection chamber and intercept the gas flow from the nozzle as it enters into an open region of the collection chamber. The chamber is provided with a partition which divides the chamber into an upper section and a lower section. Each gas centrifuge is attached to the partition. The gas centrifuge is circular in cross section and has a central air passage having a free end which passes through the partition. The central air passage is surrounded by an outer region symmetrically disposed thereabout which is provided with an air inlet port. The centrifuge has a drain passage at the bottom of the centrifuge for release of liquid and particulate matter. The free end of the central air passage provides an air outlet port. Such gas centrifuges aid in separating water and any debris from the air flow before it is allowed to expand into upper section of the chamber. Placing the gas centrifuges in the collection chamber which has a large lower section that communicates with the upper section via the gas centrifuges allows the collection chamber to serve as an buffering reservoir to reduce the effect of fluctuations in the air flow into the compressor which can result from temporary blockage of the air flow into the nozzle.

When at least one gas centrifuge is employed in the collection chamber, a transport duct directs the incoming air to each gas centrifuge to assure that the air entering the at least one gas centrifuge enters at a high velocity. The transport duct is sealably attached to the air inlet port of each of the gas centrifuges. The transport duct resides in the collection chamber, which has at least one chamber inlet to which the transport duct is also sealed.

The chamber inlet is in turn is sealably engaged with a wall of the collection chamber, and communicates with the nozzle body via at least one nozzle conduit, which is preferably a flexible tube and sealably attached to the a least one chamber inlet. Thus, air drawn into the nozzle body passes through the nozzle conduit, the chamber inlet, the transport duct, and the air inlet ports of the gas centrifuges before being drawn into the upper section of the collection chamber. As the air passes through the gas centrifuges, entrained water and particulate matter fall to bottom of the collection chamber.

Means for emptying accumulated water and/or debris from the collection chamber are provided. One or more sealable drains located in the lower section of the collection chamber can be provided for the elimination of liquids. However, since the collected water frequently contains substantial amounts of dust and debris, it is also preferred to provide a larger sealed cleanout door to provide access for readily removing any collected solid debris.

BRIEF DESCRIPTION OF THE FIGURES

FIG. 8 also better illustrates the multiple-bar linkage which provides sufficient freedom to allow the nozzle to maintain a constant orientation with respect to the pavement surface as it advances across the pavement surface, thereby maintaining the size of the controlled gap between the nozzle damper and the paved surface and maintaining a trailing edge seal engaged with the paved surface.

As shown in FIG. 9, this embodiment also employs a structure for forcibly engaging the trailing edge seal with the paved surface that allows larger springs to be employed to provide more reliable biasing action.

DETAILED DESCRIPTION OF THE PREFERRED EMBODIMENTS

Figure 1:
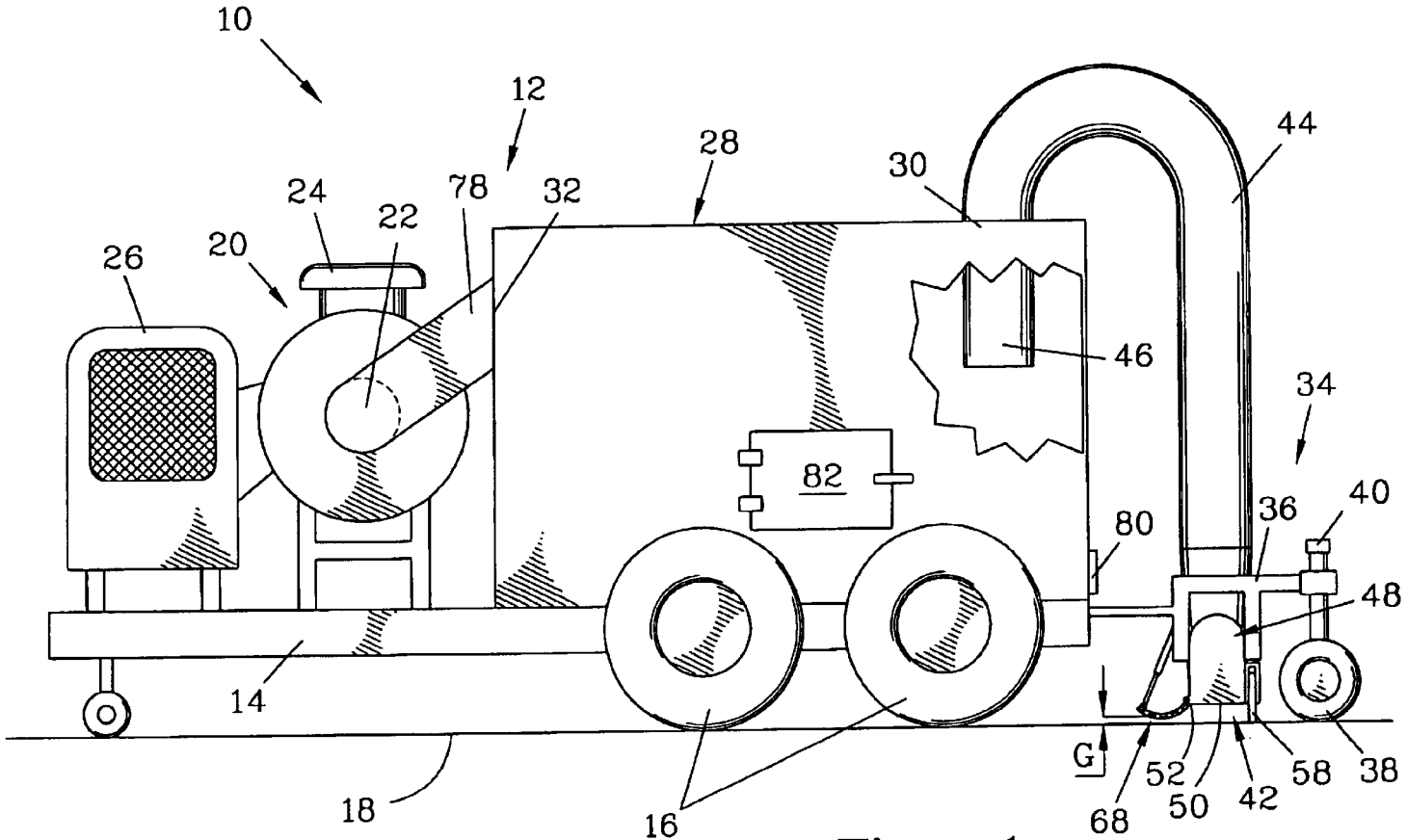
FIG. 1 is a side view illustrating the arrangement of a pavement dryer which forms one embodiment of the present invention. The pavement dryer has a gas processing system having a system frame which is wheel-mounted to traverse a paved surface to be dried. The gas processing system has an engine-driven compressor and a collection chamber, both mounted on the system frame. The collection chamber has a chamber outlet duct that communicates with a compressor intake port of the compressor, and the gas processing system communicates with a pick-up assembly via a nozzle conduit. The pick-up assembly has an assembly frame, which is mounted on assembly wheels and is affixed to the system frame; however, the assembly frame has sufficient flexibility to allow a nozzle mounted thereto to move with respect to the system frame. The nozzle has a nozzle body with a nozzle opening bounded by a nozzle leading edge, to which a nozzle damper is movably mounted to serve as a nozzle lip, and a nozzle trailing edge, having a trailing edge seal resiliently mounted thereto. The nozzle damper of this embodiment is pivotably mounted to the nozzle leading edge and configured to present a convex surface facing the paved surface. The position of the nozzle damper is adjusted to maintain a sufficient air flow velocity to remove water from the paved surface as the air is drawn into the nozzle body. Water on the paved surface is entrained into air drawn into the nozzle body and enters the collection chamber at a chamber inlet. The large volume of the collection chamber slows the air flow as it enters, allowing the entrained water to settle out in the collection chamber before the air is drawn into the compressor.

FIG. 1 is a side view of a pavement dryer 10 that forms one embodiment of the present invention. The pavement dryer 10 is designed to be pulled rather than to be self-propelled. The pavement dryer 10 has a gas processing system 12 having a system frame 14 which is mounted on transporting wheels 16. The transporting wheels 16 allow the gas processing system 12 to be drawn across a paved surface 18.

A compressor 20 having a compressor intake port 22 and a compressor exhaust port 24 is mounted on the system frame 14. An engine 26 mounted on the system frame 14 drives the compressor 20. A collection chamber 28 having a chamber inlet 30 and a chamber outlet 32 is also mounted on the system frame 14.

A pick-up assembly 34 is provided, which is configured and positioned with respect to the paved surface 18 so as to remove water and debris from the paved surface 18 as the pick-up assembly 34 passes thereover. The pick-up assembly 34 has an assembly frame 36 that is mounted on assembly wheels 38 and attached to the system frame 14 of the gas processing system 12. To promote some adjustment between the pick-up assembly 34 and the system frame 14, the assembly frame 36 is flexible. The flexibility of the assembly frame 36 allows a limited degree of movement to let the pick-up assembly pitch and roll with respect to the system frame when the paved surface 18 is uneven. However, the degree of motion is very limited, and the assembly frame 36 may be subject to vibrations at high speeds.

The assembly wheels 38 are preferably adjustably mounted to the assembly frame 36 to provide adjustment of the height of the assembly frame 36 with respect to the paved surface 18. In this embodiment, the adjustment is accomplished by turning jack screws 40.

The assembly frame 36 supports a nozzle 42. The nozzle 42 communicates with the collection chamber 28 of the gas processing system 12 via a nozzle conduit 44, which connects the nozzle 42 to the chamber inlet 30. Preferably, the chamber inlet 30 has an inlet extension 46 which directs water and debris entrained in the air flow downward and which is of sufficient length that the water and debris are released into the collection chamber 28 at a level below that of the chamber outlet 32.

Figure 2:
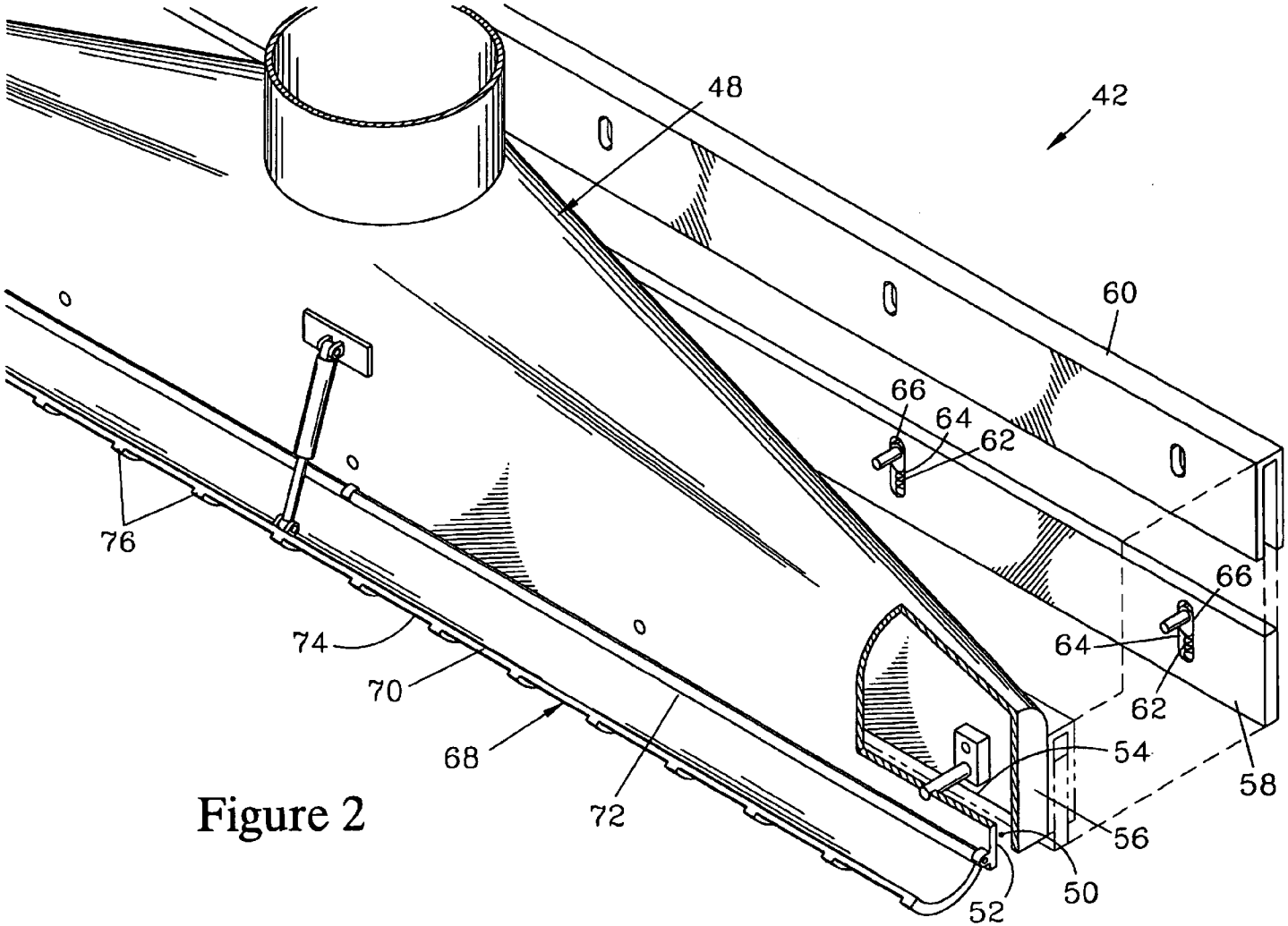
FIG. 2 is a partially exploded view showing further details of the nozzle shown in FIG. 1. In this embodiment, the trailing edge seal is mounted in a trailing edge seal bracket, which is affixed to the nozzle body in the vicinity of the trailing edge, and springs bias the trailing edge seal into engagement with the paved surface. The nozzle damper has a pavement-facing side that provides the convex surface, and is provided with skids attached to the pavement-facing side such that they engage the paved surface to limit the position of the damper to prevent it from sealably engaging the paved surface.

As better shown in FIG. 2, the nozzle 42 has an elongated nozzle body 48 having a nozzle opening 50 bounded by a nozzle leading edge 52 and a nozzle trailing edge 54. In this embodiment, the nozzle opening 50 is rectangular, and is also bounded by a pair of end caps 56 (only one of which is shown).

Air is blocked from flowing into the nozzle opening 50 from under the nozzle trailing edge 54 by a trailing edge seal 58 which is mounted in a trailing edge seal bracket 60. The trailing edge seal 58 is biased toward the paved surface 18 by blade springs 62 which reside in seal slots 64 which slidably engage seal blocks 66. The trailing edge seal 58 is preferably made of a resilient material so it can conform to the paved surface and accommodate any irregularities therein.

Air flow under the nozzle leading edge 52 is controlled by a nozzle damper 68 which serves as a nozzle lip extending across the nozzle leading edge 52 and providing a controlled gap G (shown in FIG. 1) between the nozzle leading edge 52 and the paved surface 18. The nozzle damper 68 is movably mounted with respect to the nozzle leading edge 52 so that movement of the nozzle damper 68, in combination with the adjustment of the assembly wheels 38, provides means for adjusting the size of the controlled gap G.

The nozzle damper 68 has a forward damper region 70 and a rear damper region 72, and is configured so as to provide a convex surface 74 that faces the paved surface 18. The rear damper region 72 is pivotally attached to the nozzle body 48 in the vicinity of the nozzle leading edge 52 such that the nozzle damper 68 acts as a flap. The pivotal attachment provides a rocking action that allows debris to flow past the nozzle damper 68. The nozzle damper 68 is also provided with spaced apart skids 76 which prevent the nozzle damper 68 from becoming sealably engaged with the paved surface 18 and set a minimum size for the controlled gap G between the paved surface 18 and the nozzle leading edge 52. Preferably, skids 76 have a thickness that limits the controlled gap G to a minimum value of about ¼ inch (6 mm). The skids 76 can be fabricated from a wear-resistant material to also serve as wear surfaces to prevent damage to the remainder of the nozzle damper 68.

Referring again to FIG. 1, the pressure in the collection chamber 28 of the gas processing system 12 must be maintained below atmospheric pressure to provide a pressure drop that acts to induce flow across the nozzle leading edge 52. The pressure in the collection chamber 28 is reduced by running the compressor 20 while the compressor intake port 22 is connected to the chamber outlet 32 via a chamber outlet duct 78.

Since the gap G between the nozzle damper 68 and the paved surface 18 is small, the air flow rate through the gap G and the nozzle 42 is high if the pressure in the collection chamber 28 is substantially reduced, and water and debris on the paved surface 18 are carried into the collection chamber 28 through the nozzle opening 50 and the nozzle conduit 44. In fact, under some conditions the air flow is sufficiently strong as to entrain water into the air flow and create a puddle-free region of the paved surface 18 ahead of the nozzle leading edge 52. In the collection chamber 28, the air flow rate is low because of the large volume of the collection chamber 28, and the solid and liquid materials settle from the air flow and collect in the bottom of the collection chamber 28. The collection chamber 28 is provided with a drain port 80 for removal of the collected liquid. An access door 82 is provided to allow the removal of any collected debris.

Figure 3:
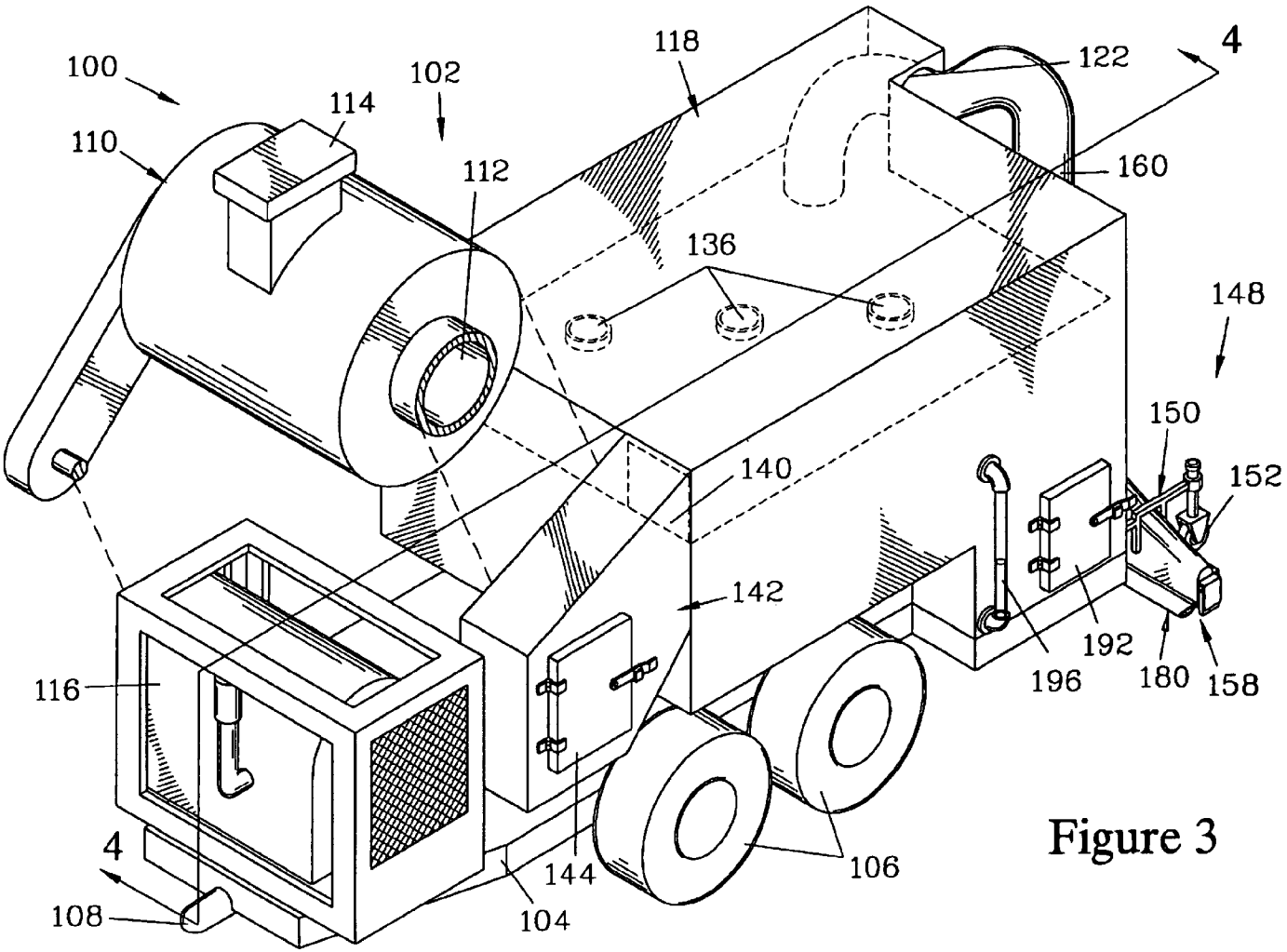
FIG. 3 is a partially exploded isometric view of a pavement dryer of the present invention which has many features in common with the embodiment shown in FIGS. 1 and 2, but which differs in details of the collection chamber, the nozzle, and the structure that connects the pick-up assembly to the gas processing system.
Figure 4:
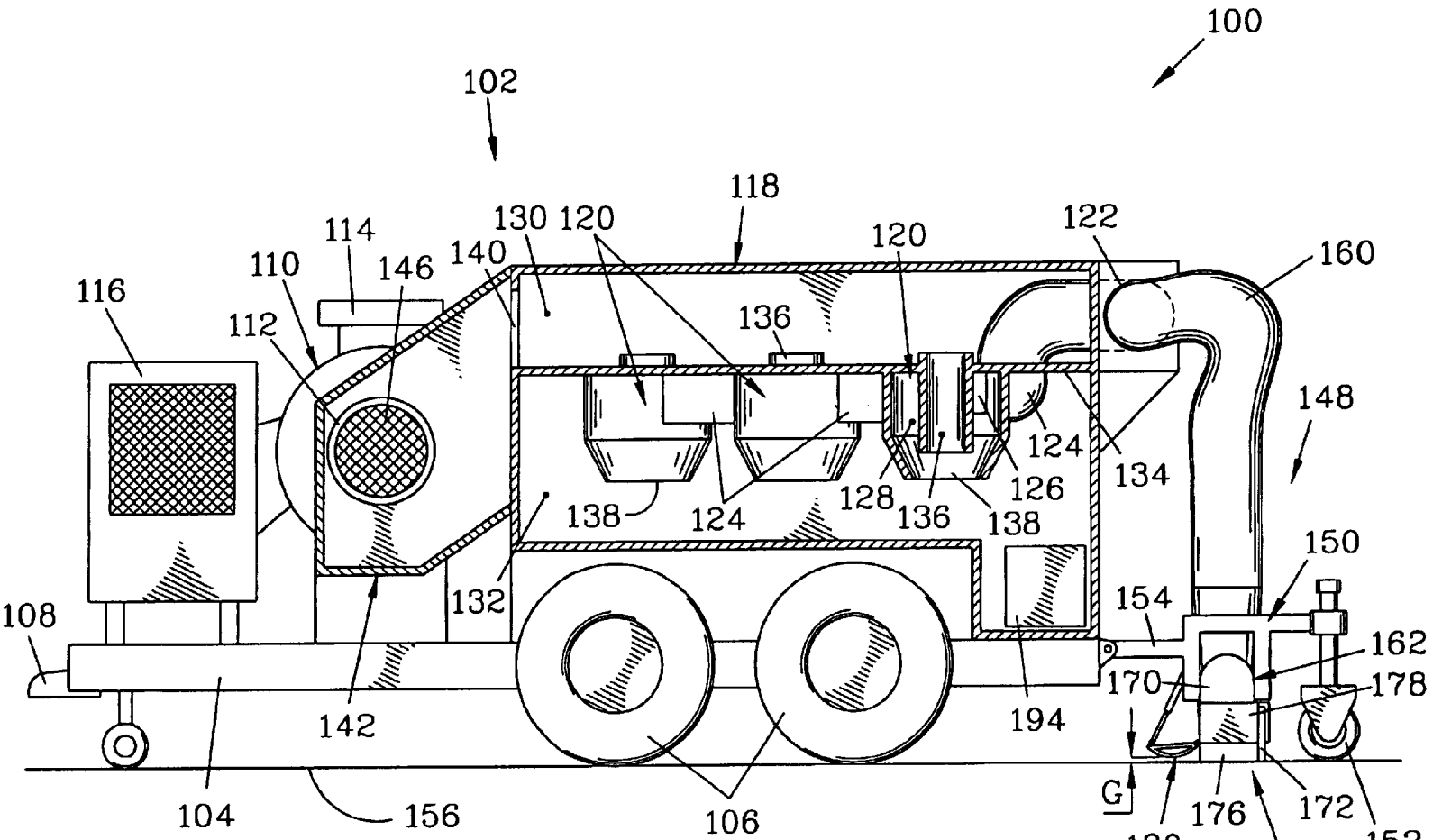
FIG. 4 is a view of the section 4—4 of FIG. 3. The collection chamber of this embodiment has an upper section and a lower section separated by a partition. Ducts direct the air flow from the nozzle to three gas centrifuges. A central passage through each of the centrifuges provides communication between the upper section and the lower section. The gas centrifuges separate the entrained water from the air flow flowing therethrough, the water collecting in the lower section of the collection chamber while the air ultimately passes into the upper section, where it is drawn through the chamber outlet duct to the compressor.

FIGS. 3 and 4 are two views of a pavement dryer 100 that forms another embodiment of the present invention, and which addressees the limitation of having the system frame of the gas processing system affixed to the assembly frame of the pick-up assembly. FIG. 3 is a partially exploded isometric view of the pavement dryer 100, while FIG. 4 is a view of the section 4—4 of FIG. 3. The pavement dryer 100 has a gas processing system 102 that is designed to operate under conditions where the quantities of liquid and solid debris that pass through the nozzle are substantially greater in quantity than can be readily handled by the pavement dryer 10. The pavement dryer 100 employs many of the elements of the pavement dryer 10 shown in FIGS. 1 and 2. The pavement dryer 100 has a system frame 104 which is mounted on transporting wheels 106. However, the wheels 106 are more centrally located so as to reduce the load on a hitch 108 used to tow the pavement dryer 100. A compressor 110, having a compressor intake port 112 and compressor exhaust port 114, is mounted on the system frame 104 and is driven by an engine 116 which is also mounted on the system frame 104.

The gas processing system 102 has a collection chamber 118 that is mounted on the system frame 104. As shown in FIG. 4, the collection chamber 118 has three gas centrifuges 120 contained therein that communicate with a chamber inlet 122 of the collection chamber 118 via a transport duct 124. The transport duct 124 sealably engages an air inlet port 126 of each of the gas centrifuges 120 that tangentially intersects an outer region 128 of the gas centrifuge 120. The collection chamber 118 is a bifurcated chamber having an upper section 130 and a lower section 132 separated by a partition 134.

Each of the gas centrifuges 120 has a central air passage 136 which communicates between the lower section 132, via a drain passage 138, and the upper section 130. Air entering the air inlet port 126 passes through the outer region 128, spiraling downwards towards the drain passage 138 before it can enter the central air passage 136 and pass upward into the upper section 130. Since the spiraling action of the air flow tends to throw liquid and particulate matter against the perimeter of the gas centrifuge 120, the air in the central region that is drawn into the central air passage 136 is substantially free of liquid and particulate matter. The drain passage 138 in the bottom of each of the gas centrifuges 120 allows the separated liquid and particulate matter to drain from the gas centrifuges 120 into the lower section 132 of the collection chamber 118. The gas centrifuges 120 are preferably positioned in a diagonal configuration to reduce the overall length of the collection chamber 118. It is also preferred for the gas centrifuges 120 to be positioned in the lower section 132 of the collection chamber 118 to facilitates forming the gas centrifuges 120 integrally with the partition 134.

A chamber outlet 140 is provided in the upper section 130, and communicates with the compressor intake port 112 of the compressor 110. In this embodiment, an extension chamber 142 connects the compressor intake port 112 to the chamber outlet 140. The extension chamber 142 is provided with an extension chamber door 144 (shown in FIG. 3) to provide access to the extension chamber 142 for removal of any residual debris that may be collected therein. A grill 146 (shown in FIG. 4) can be employed to cover the compressor intake port 112 of the compressor 110 to avoid the entry of any debris which might otherwise be drawn to the compressor intake port 112; however, such is done at the expense of partial obstruction of air flow into the compressor intake port 112 by the grill 146. If the grill 146 is employed, it is preferably formed of round wire to reduce its obstruction of the air flow. The extension chamber door 144 also allows access for cleaning accumulated material from the grill 146 when such is employed.

Figure 5:
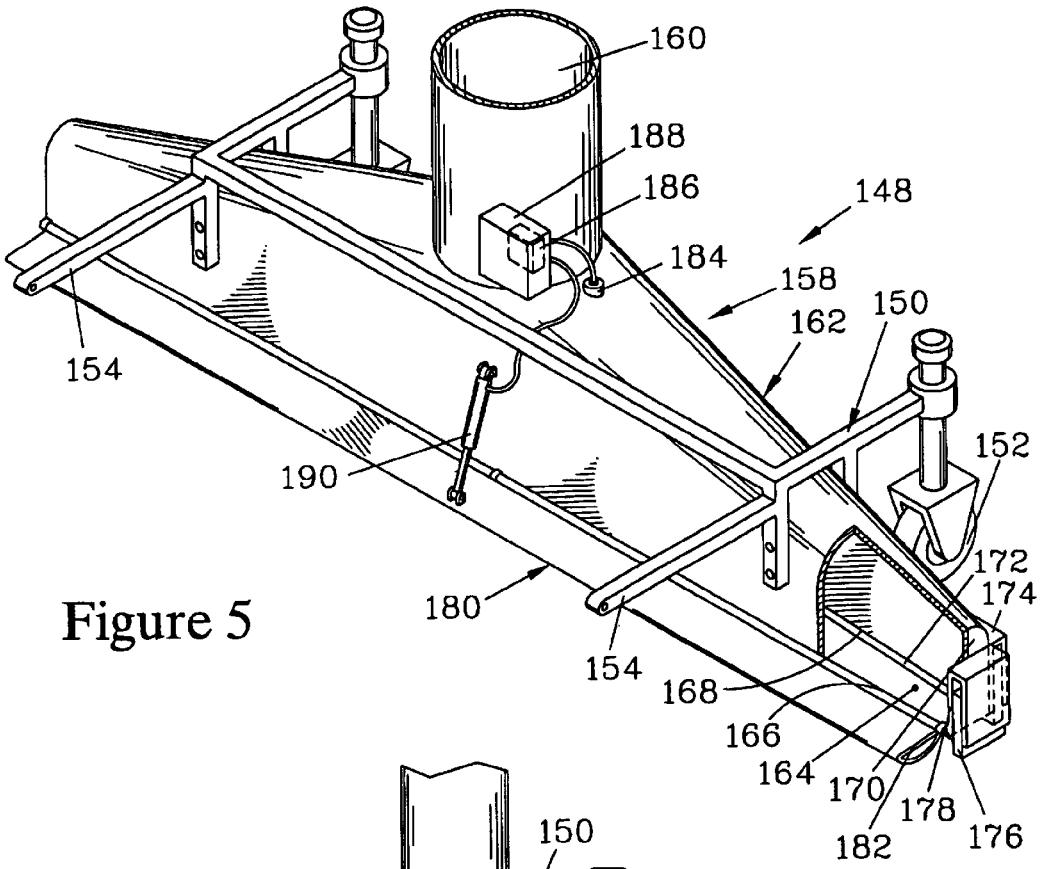
FIG. 5 is an isometric view showing further details of the nozzle employed in the embodiment shown in FIGS. 3 and 4. The nozzle has end seals to further limit air flow into the nozzle opening, and differs in the details of the nozzle damper which is employed to control the flow. The nozzle also has a pressure tap that allows the pressure in the nozzle to be monitored by a control system which can automatically adjust the position of the nozzle damper.

The pavement dryer 100 also has a pick-up assembly 148, which employs many of the structural elements of the pick-up assembly 34, and which is better illustrated in FIG. 5. The pick-up assembly 148 has an assembly frame 150 adjustably attached to a pair of assembly wheels 152. In this embodiment, the assembly frame 150 is pivotably connected with respect to the system frame 104 by a pair of connection arms 154. The pivotable connection of the assembly frame 150 to the system frame 104 allows greater freedom of motion for the pick-up assembly 148. This freedom is particularly helpful in this embodiment, since the pick-up assembly 148 is substantially displaced from the transport wheels 106, which will tend to increase the effect of pitching of the system frame 104 as it traverses a paved surface 156. The pivotable connection allows the pick-up assembly 148 to pitch with respect to the system frame 104, thereby allowing the assembly wheels 152 to remain in contact with the paved surface 156 if the paved surface 156 undulates. When the connection arms 154 are widely spaced and somewhat loosely connected, the pick-up assembly 148 has a limited degree of lateral tilting with respect to the system frame 104 to accommodate lateral swaying of the gas processing system which may occur when the paved surface is a race track with steeply banked curves.

The assembly frame 150 supports a nozzle 158 that communicates with the chamber inlet 122 via a nozzle conduit 160. The nozzle conduit 160 also helps damp vibration resulting from irregularities in the paved surface 156 by damping any rocking of the nozzle 158.

Figure 6:
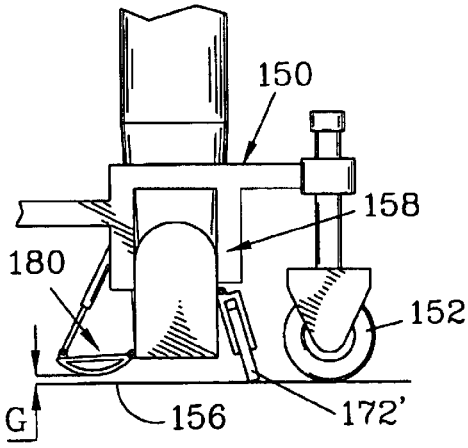
FIG. 6 is a side view of another embodiment of a pick-up assembly that is similar to the pick-up assembly shown in FIG. 5, but which employs an alternative scheme for movably mounting the trailing edge seal to the nozzle body so as to forcibly engage the trailing edge seal with the paved surface.

Referring to FIG. 5, the nozzle 158 has an elongated nozzle body 162 with a nozzle opening 164 bounded by a nozzle leading edge 166, a nozzle trailing edge 168, and a pair of end caps 170 (only one of which is shown). A trailing edge seal 172 is mounted in a trailing edge seal bracket 174 to seal the trailing edge 168 with respect to the paved surface 156. In the embodiment illustrated, the motion of the trailing edge seal 172 is substantially perpendicular to the paved surface 156. It would be possible to employ a trailing edge seal 172' (as illustrated in FIG. 6) that is mounted so as to provide a pivoting motion with respect to the paved surface 156. Such pivoting motion might reduce chatter if the paved surface 156 undulates.

In the pavement dryer 100, each of the pair of end caps 170 is provided with end seals 176 mounted in end seal brackets 178 to seal the ends of the nozzle opening 164 with respect to the paved surface 156. The end seals 176 as illustrated will function in a manner similar to that of the trailing edge seal 172; however, it has been found that the end seals 176 can be affixed to the end caps 170 such that they can be placed in close proximity to the paved surface 156 to substantially block air flow under the end caps 170 while not being subject to the wear that would occur if the end seals 176 were forcibly engaged with the paved surface 156. When the ends seals 176 are affixed to the end caps 170 they can be brought into proximity to the paved surface 156 by the adjustment of the assembly wheels 152. However, it is preferred for the end seals 176 to be adjustably mounted with respect to the end caps 170.

The nozzle leading edge 166 is fitted with a nozzle damper 180 which is similar in structure to the nozzle damper 68 illustrated in FIG. 2, but which lacks skids and which is provided with a damper upper member 182 (shown in FIG. 5) to provide rigidity. The nozzle damper 180 again serves as a nozzle lip which traverses the nozzle leading edge 166 and forms a controlled gap G between the nozzle leading edge 166 and the paved surface 156.

The pick-up assembly 148 of this embodiment also differs from the pick-up assembly 34 of the embodiment illustrated in FIGS. 1 and 2 in that means for adjusting the pressure in the nozzle 158 as a function of the paved surface conditions are provided. The means includes a pressure tap 184 in the nozzle 158 to allow monitoring of the pressure therein. The pressure tap 184 allows communication of the internal pressure to a microprocessor 186 which provides a signal to a damper controller 188 which adjusts the length of a linear actuator 190 connected between the nozzle body 162 and the nozzle damper 180. The linear actuator 190 and the movable attachment of the nozzle damper 180 to the nozzle body 162 provide means for adjusting the size of the gap G between the nozzle damper 180 and the paved surface 156, allowing a relatively constant pressure to be maintained in the nozzle 158. The effectiveness of this embodiment is dependent on the pressure regulating system. Since there are no skids on the nozzle damper 180 and the extremities of the nozzle opening 164 are sealed, pressure fluctuation can result in occasional sealing of the nozzle 158 with respect to the paved surface 156 and seizing of the nozzle 158 to the paved surface 156. This problem would be accentuated if only the gas centrifuges 120 were to be used to process the air from the nozzle conduit 160. Positioning the gas centrifuges 120 in the collection chamber 118 as described above allows the collection chamber 118 to provide a reservoir of air to buffer the effect of any temporary sealing of the nozzle 158, simplifying recovery and reducing surges in the compressor loading and the tendency for the nozzle 158 to affix to the paved surface 156. In the event that air flow into the chamber inlet 122 is momentarily blocked by sealing of the nozzle 158, air from the large volume retained in the lower section 132 can be drawn through the central air passages 136 to prevent damage to the compressor 110 and allow the nozzle 158 to be released from the paved surface 156 as it advances thereacross.

Referring again to FIGS. 3 and 4, the lower section 132 of the collection chamber 118 preferably has a pair of cleanout doors (192, 194) to allow draining water from the lower section 132 as well as to facilitate removing particulate material collected therein. To allow an operator to readily monitor the level of water collected in the lower section 132, a sight glass 196 can be provided on the side of the collection chamber 118. Alternatively, an electronic sensor could be employed to monitor the level of the water, in which case the sensor could be connected to activate an alarm and/or shut off air flow through the pick-up assembly 148 when the water reaches a selected level.

Figure 7:
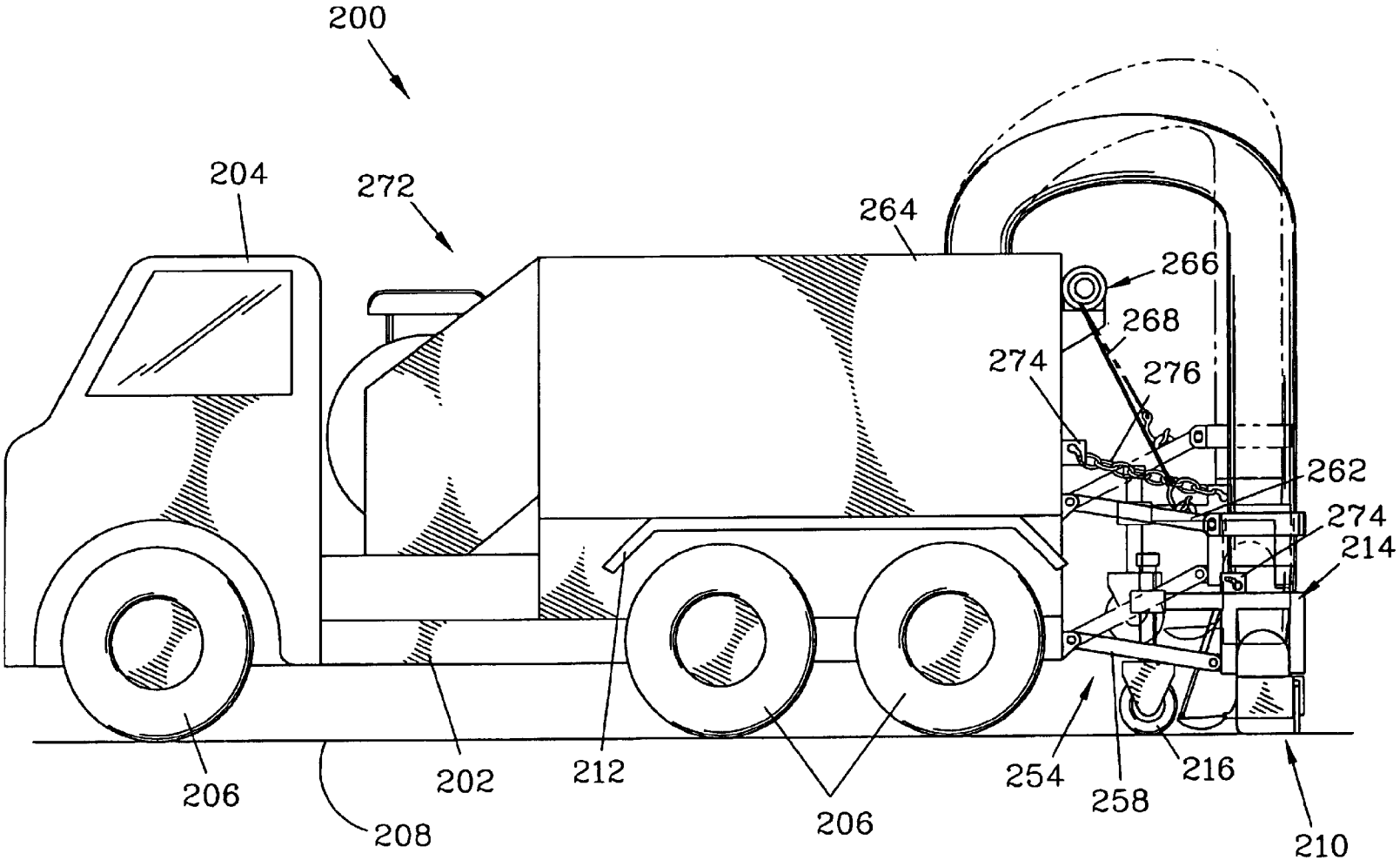
FIG. 7 illustrates another embodiment of the present invention, a self-propelled pavement dryer. This embodiment has a system frame to which are mounted a cab and an engine. The engine drives transport wheels to propel the pavement dryer. In this embodiment, the assembly frame is connected to the system frame by a multiple-bar linkage that provides stability for the nozzle during use, and which also allow the nozzle to be brought into close proximity with the pavement, as illustrated, or into a raised storage position, shown in phantom, for storage and transport between work sites.

FIG. 7 illustrates another embodiment of the present invention, a pavement dryer 200 which shares many of the features of the earlier embodiments and, in particular, the pavement dryer 100 illustrated in FIGS. 3 and 4. It differs in part from the earlier embodiments in that the pavement dryer 200 has a system frame 202 which is elongated and can accommodate a cab 204 with an engine (not shown) so that the pavement dryer 200 can be self propelled. This feature results in a substantially longer wheel base between transport wheels 206, and thus the system frame 202 may pitch when a paved surface 208 over which the pavement dryer 200 is driven is uneven. To accommodate this longer wheel base and the fact that the pavement dryer 200 may be driven over open roads which undulate, the pavement dryer 200 employs a pick-up assembly 210 that is pivotally attached with respect to the system frame 202 and, as discussed in greater detail below, can be raised to a storage position, illustrated in phantom. Preferably, fenders 212 are provided to cover those of the transport wheels 206 near the pick-up assembly 210 to prevent the transport wheels 206 from spraying water which might pass by the pick-up assembly 210.

Figure 8:
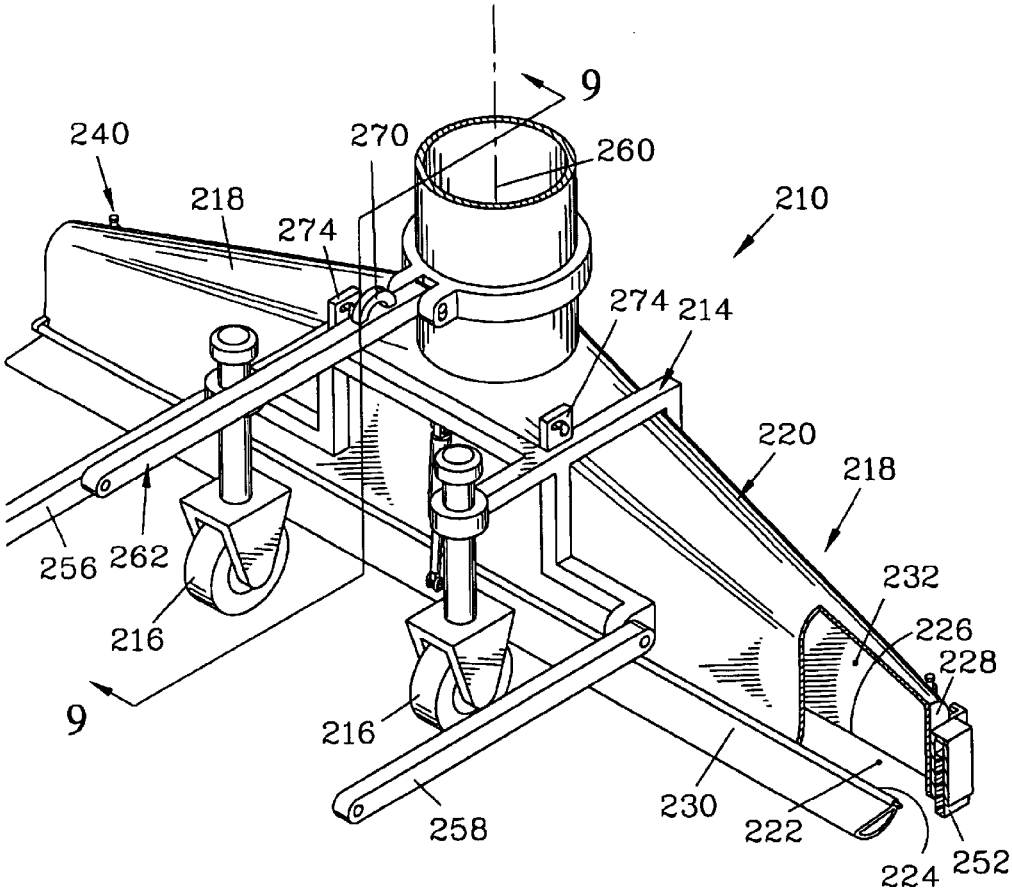
FIG. 8 is an isometric view of the pick-up assembly of the embodiment shown in FIG. 7. In addition to the improved towing structure, the stability of the pick-up assembly is improved by placing a pair of assembly wheels ahead of the nozzle, rather than trailing the nozzle as in earlier embodiments. The nozzle of this embodiment differs from those discussed earlier in that the nozzle body is provided with a passage surface contoured to form a substantially continuous curve with the nozzle damper to reduce turbulence in the air flow into the nozzle passage.
Figure 9:
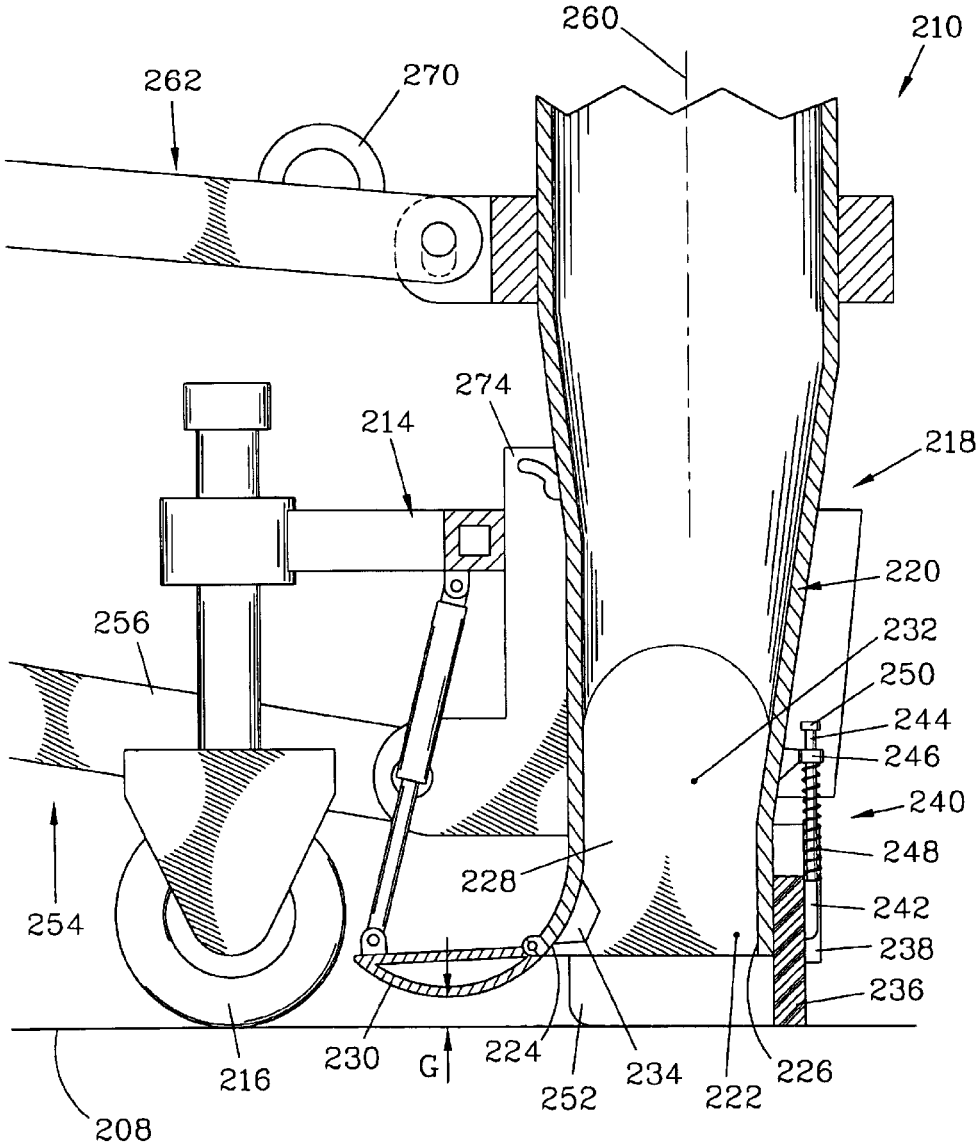
FIG. 9 is a view of the section 9—9 of FIG. 8, better illustrating the contoured passage surface of the nozzle body. In this embodiment to further promote smooth air flow, vanes are positioned in the nozzle passage.

FIG. 8 is an isometric view showing further details of the pick-up assembly 210 shown in FIG. 7, while FIG. 9 is a view of the section 9—9 of FIG. 8. The pick-up assembly 210 has an assembly frame 214 adjustably mounted on assembly wheels 216 and supporting a nozzle 218 having an elongated nozzle body 220. The assembly wheels 216 are mounted ahead of the nozzle 218 to provide better stability during operation.

The elongated nozzle body 220 has a nozzle opening 222 which is bounded by a nozzle leading edge 224, a nozzle trailing edge 226, and a pair of end caps 228. The nozzle leading edge 224 terminates at a nozzle damper 230 which provides a nozzle lip. The nozzle body 220 is preferably contoured in the vicinity of the nozzle leading edge 224 to form a smooth transition between a nozzle passage 232 and the nozzle damper 230 to reduce turbulence in the flow of air and entrained water and debris passing under the nozzle damper 230 into the nozzle opening 222, as best shown in FIG. 9. To further promote smooth flow of the air into the nozzle opening 222, vanes 234 (one of which is shown in FIG. 9) can be mounted in the nozzle passage 232 near the nozzle leading edge 224. The vanes 234 are aligned normal to the nozzle leading edge 224 to help direct the air flow into the nozzle opening 222 and maintain the air flow even across the width of the nozzle leading edge 224. The nozzle damper 230 is pivotably attached to the nozzle body 220 to provide means for adjusting the size of a controlled gap G (shown in FIG. 9) between the paved surface 208 and the nozzle lip to suit the particular pavement conditions.

A trailing edge seal 236 is employed, which forcibly engages the paved surface 208. As best shown in FIG. 9, the trailing edge seal 236 is guided by channels 238 and is biased toward the paved surface 208 by a spring assembly 240. The spring assembly 240 has a series of brackets 242, which attach to the resilient trailing edge seal 236, as well as a corresponding series of substantially vertical rods 244. It should be appreciated that the series of brackets 242 could be formed by a single member that substantially traverses the trailing edge seal 236. Each of the rods 244 is attached to one of the brackets 242 and is guided by a rod guide 246 through which the rods 244 pass. Springs 248, each captured on one of the rods 244, bias the brackets 242 away from the rod guides 246, which are affixed with respect to the nozzle body 220. The rods 244 are each maintained in engagement with the corresponding rod guide 246 by a rod terminating cap 250 of a size sufficient to assure that the rod 244 is maintained in the rod guide 246. End seals 252 are provided to limit ingress of air and water under the end caps 228, causing any air and water to pass under the nozzle damper 230.

For the nozzle 218 to function most effectively, the nozzle 218 should be maintained at a relatively constant position with respect to the paved surface 208 to maintain the desired size of the controlled gap G. To aid in assuring that such a relationship is maintained when the pick-up assembly 210 is being towed by the system frame 202, it is preferred that a multiple-arm linkage 254 be employed to provide means for adjustably connecting the assembly frame 214 to the system frame 202. The multiple-arm linkage 254 illustrated has a first tow bar 256 and a second tow bar 258, both of which pivotably attach to the assembly frame 214 and to the system frame 202. The first and second tow bars (256, 258) are symmetrically disposed with respect to a central axis 260 of the nozzle 218, and attach to the assembly frame 214 at about the level of the assembly wheels 216 to reduce the moment arm of torques applied by towing. A stabilizing bar 262 pivotably attaches to a collection chamber 264 of the pavement dryer 200, as shown in FIG. 7. The stabilizing bar 262 attaches both pivotably and slidably to the assembly frame 214 to prevent binding.

The pivotable attachment of the bars (256, 258, 262) in the linkage 254 to the system frame 202 and the assembly frame 214 is preferably provided with sufficient free play to allow the pick-up assembly 210 to tilt laterally relative to the system frame 202. Such freedom of motion could be achieved by connecting the assembly frame 214 to the system frame 202 by some form of universal joint, such as a conventional ball-and-socket trailer hitch, an example of which is the hitch 108 illustrated in FIGS. 3 and 4; however, the linkage 254 illustrated is preferred, since it keeps the nozzle 218 oriented normal to the path of travel while in use and serves to maintain the position of the pick-up assembly 210 if the pavement dryer 200 is moved backwards.

When transporting the pavement dryer 200 over long distances, it is preferred to raise the pick-up assembly 210, as shown in phantom in FIG. 7, to reduce wear on the assembly wheels 216. For this purpose, a winch 266 can be mounted to the collection chamber 264 and connected to the pick-up assembly 210. In the illustrated embodiment, the winch 266 has a cable 268 that is connected to an eye 270 on the stabilizing bar 262, near the point at which the stabilizing bar 262 connects to the nozzle 218. To raise the pick-up assembly 210, a gas processing system 272 of the pavement dryer 200 is placed in an idle condition to eliminate the air flow through the nozzle body 220 which would otherwise act to hold the nozzle body 220 in close proximity to the paved surface 208. The winch 266 is then activated to retract the cable 268 to raise the pick-up assembly 210 off of the paved surface 208. Preferably, the gas processing system 272 and the winch 266 can be controlled remotely, such as from the cab 204 mounted on the system frame 202. While the illustrated embodiment employs the winch 266, a hydraulic cylinder or other means could be employed to lift the pick-up assembly 210. The multiple-bar linkage 254 employed in this embodiment is also preferred since it stabilizes the pick-up assembly 210 when the pick-up assembly 210 is out of service raised for transporting.

To further stabilize the pick-up assembly 210 when raised, it is preferred for the pick-up assembly 210 and the gas processing system 272 to be provided with corresponding chain plates 274. When the pick-up assembly 210 has been raised by the winch 266 or other lifting means as described above, chains 276 (one of which is shown in the phantom view of FIG. 7) can be connected between the chain plates 274 to secure the pick-up assembly 210 in the raised position for transport.

Figures 10, 11, 12:
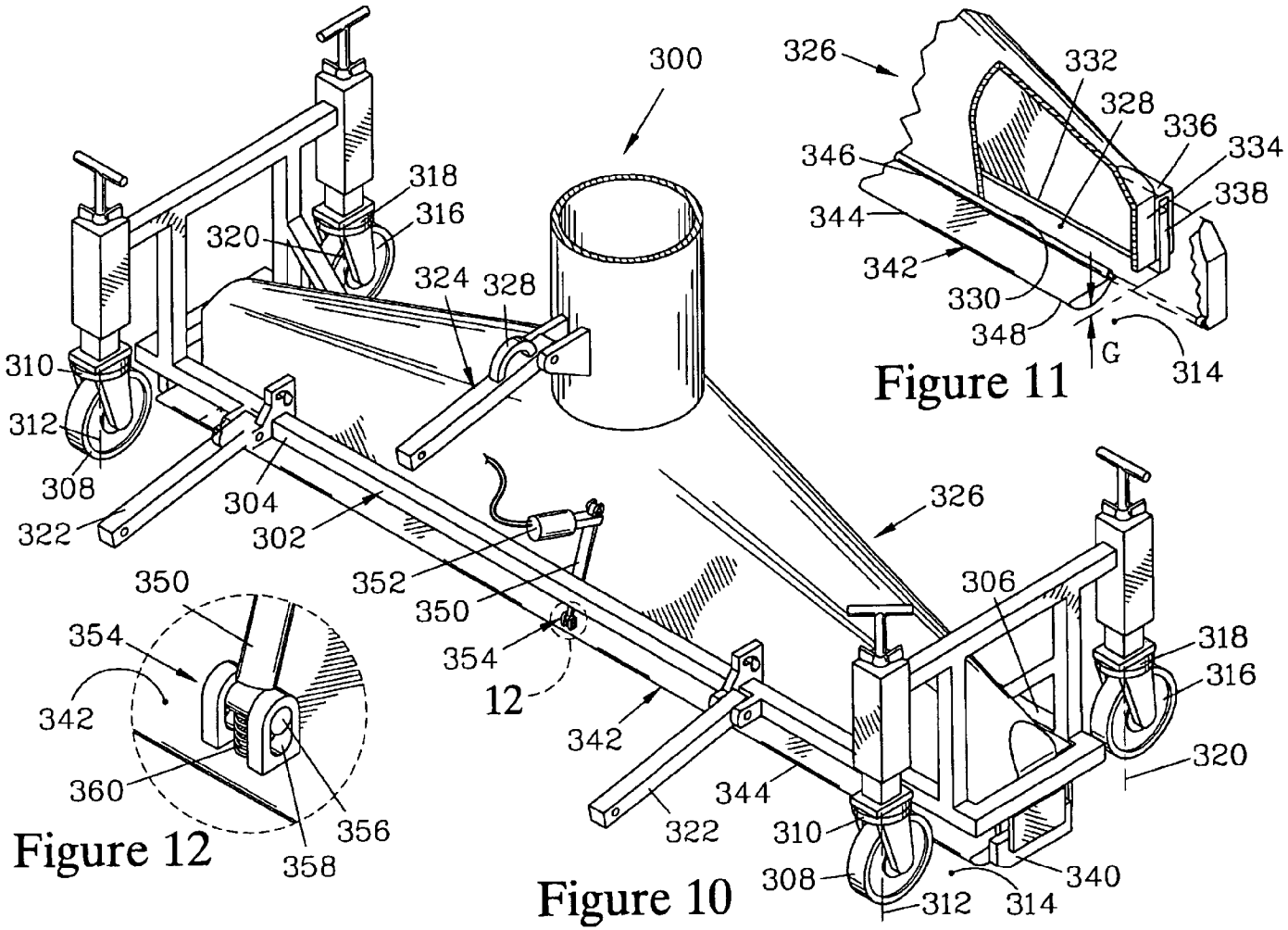
FIG. 10 is an isometric view of yet another embodiment of the present invention, a pick-up assembly which has a nozzle body mounted to a frame that is supported on two pairs of wheels for improved stability during use. The pairs of wheels are also in close proximity to the nozzle body so as to track the local pavement conditions and allow the nozzle to be maintained in closer proximity to the pavement. The wheels are each mounted so as to be rotatable about an axis that is normal to the axis of rotation of the wheel to aid in moving the pick-up assembly on a curved path.
FIG. 11 is a partial view of the nozzle body shown in FIG. 10, where a portion of the nozzle body has been cut away to better illustrate the structure.
FIG. 12 is an enlarged view of the region 12 of FIG. 10, illustrating a spring-biased connection that provides resiliency in the positioning of a pivotable nozzle damper.

FIG. 10 illustrates another embodiment of the present invention, a pick-up assembly 300 which is suitable for use with a gas processing system such as those illustrated in FIGS. 1, 3, 4, and 7. The pick-up assembly 300 has an assembly frame 302, which in this embodiment is rectangular, having a forward frame member 304 and a rear frame member 306. The forward frame member 304 is supported by a forward pair of wheels 308 which are each rotatably mounted to the frame 302 with swivel joints 310 which allow the wheels 308 to pivot about a pivot axis 312 that is substantially normal to a paved surface 314. Similarly, the rear frame member 306 is supported by a rear pair of wheels 316 which are each rotatably mounted to the frame 302 with a swivel joints 318 about a wheel pivot axis 320 that is substantially normal to the paved surface 314. The use of both the forward pair of wheels 308 and the rear pair wheels 316 provides the pick-up assembly 300 with independent support on the paved surface 314 to help prevent the effectiveness of the pick-up assembly 300 from being adversely affected by motion of a system frame (not shown) to which the pick-up assembly 300 is connected. The rotatable mounting of the wheels (308, 316) to the assembly frame 302 also facilitates moving the pick-up assembly 300 around curves. Preferably, at least one pair of the wheels (308, 316) is vertically adjustable to allow the relative position of the assembly frame 302 with respect to the paved surface 314 to be altered.

A pair of tow bars 322 are pivotably attached to the forward frame member 304 and attach to a gas processing system (not shown). The pair of tow bars 322 serve as means for adjustably connecting the assembly frame 302 to the gas processing system. A stabilizing bar 324 is also provided, and is pivotably connected between a nozzle 326 of the pick-up assembly 300 and the gas processing system. The stabilizing bar 324 extends substantially parallel to the pair of tow bars 322, and has an eye 328 located near the nozzle 326. The eye 328 allows a winch (not shown) mounted to the gas processing system to lift the pick-up assembly 300 when negotiating tight turns or for transport.

The nozzle 326 mounts to the assembly frame 302 and has a nozzle opening 328 (shown in FIG. 11) bounded by a nozzle leading edge 330, a nozzle trailing edge 332, and a pair of nozzle end caps 334. The nozzle trailing edge 332 is fitted with a bracket 336 into which is slidably engaged a resilient rear seal 338 that is spring loaded to bias the resilient rear seal 338 toward the paved surface 314 and create a seal therebetween. Resilient end seals 340 can be mounted in a manner similar to the rear seal 338, but more preferably are adjustably mounted and positioned so as to reside just above the paved surface 314 after the position of the nozzle 326 has been set by adjusting the relative positions of the wheels (308, 316). When the nozzle 326 is supported at multiple points along the assembly frame 302, the rigidity of the assembly frame 302 serves to stiffen the nozzle 326 and prevents bowing of the nozzle 326 under the force of air pressure. This rigidity allows the end seals 340 to be maintained just off of the paved surface 314, where they can substantially block air flow thereunder while not being subject to severe wear. By positioning the nozzle 326 between the forward pair of wheels 308 and the rear pair wheels 316 which are in close proximity to the nozzle 326, the nozzle 326 is provided stability relative to the paved surface 314 to prevent rocking of the nozzle 326.

A nozzle damper 342 having a damper leading edge 344 and a damper trailing edge 346 is configured to provide a convex surface 348 which faces the paved surface 314. The damper trailing edge 346 is pivotably attached to the nozzle leading edge 330, and the nozzle damper 342 thus serves as a nozzle lip that provides a controlled gap G between the paved surface 314 and the nozzle leading edge 330.

An actuator 350 is pivotally connected to the nozzle 326 and to the nozzle damper 342, and serves to adjust the magnitude of the controlled gap G. The control of the actuator 350 is provided by a controller 352 which is wired to a control box (not shown) that is manually adjusted under the supervision of the operator.

The actuator 350 is preferably resiliently connected between the nozzle 326 and the nozzle damper 342 to allow the nozzle damper 342 to accommodate impacts with objects or irregularities in the paved surface 314. One example of such a resilient connection is provided by a spring-biased pin-and-slot connection 354 that connects the actuator 350 to the nozzle damper 342, as better shown in FIG. 12. The pin-and-slot connection 354 illustrated has a pin 356 mounted to the actuator 350 and a slot 358 mounted on the nozzle damper 342. The pin 356 both rotatably and slidably engages the slot 358, and is biased to one end of the slot 358 by a bias spring 360.

Figure 13:
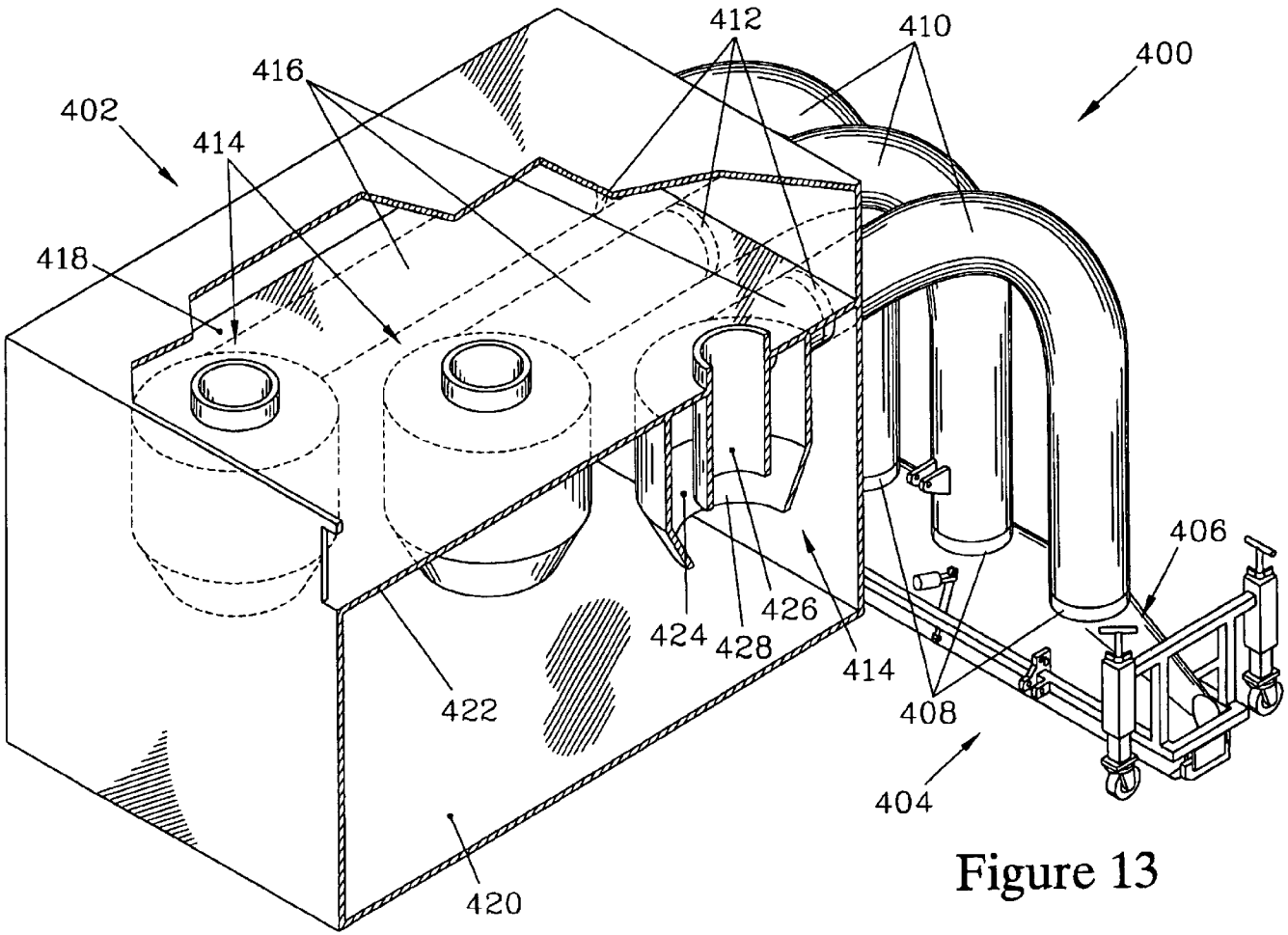
FIG. 13 is an isometric view of a collection chamber and pick-up assembly which form part of a pavement dryer that forms another embodiment of the present invention. In this embodiment, multiple conduits communicate between the pick-up assembly and the collection chamber, each conduit communicating with a separate gas centrifuge.

FIG. 13 is a partial isometric view of a pavement dryer 400 which forms another embodiment of the present invention. The pavement dryer 400 has a collection chamber 402 and a pick-up assembly 404, the remaining elements of the pavement dryer 400 not being shown. As illustrated, the pick-up assembly 404 has many features in common with the pick-up assembly 300 discussed above. The pick-up assembly 404 differs from the pick-up assemblies discussed earlier in that it has a nozzle body 406 having multiple nozzle outlets 408. In this embodiment, three nozzle outlets 408 are provided.

Each of the nozzle outlets 408 communicates with a separate nozzle conduit 410, which in turn communicates with a chamber inlet 412 of the collection chamber 402. It is preferred for the nozzle conduits 410 to be formed by smooth-walled tubes to reduce any turbulence in the air flow and eliminate stagnant air regions where water and debris can collect. The collection chamber 402 has three gas centrifuges 414, each of which communicates with one of the chamber inlets 412 via a transport duct 416.

The collection chamber 402 is a bifurcated chamber having an upper section 418 and a lower section 420 separated by a partition 422. The gas centrifuges 414 are preferably positioned in the lower section 420, and arranged diagonally. Each of the transport ducts 416 communicates with an outer region 424 of one of the gas centrifuges 414, from which air flows through a central air passage 426 to the upper section 418, while liquid and particulate matter entrained in the air flow can drain into the lower section 420 through a drain passage 428.

The use of multiple separate nozzle conduits 410, each communicating with one of the gas centrifuges 414 by an individual transport duct 416, increases the flow of air and the capacity to carry liquid and particulate matter by reducing turbulence in the air flow. Additionally, connecting the nozzle conduits 410 to multiple nozzle outlets 408 on the nozzle body 406 helps provide more even flow of air across the width of the pick-up assembly 404.

Figure 14:
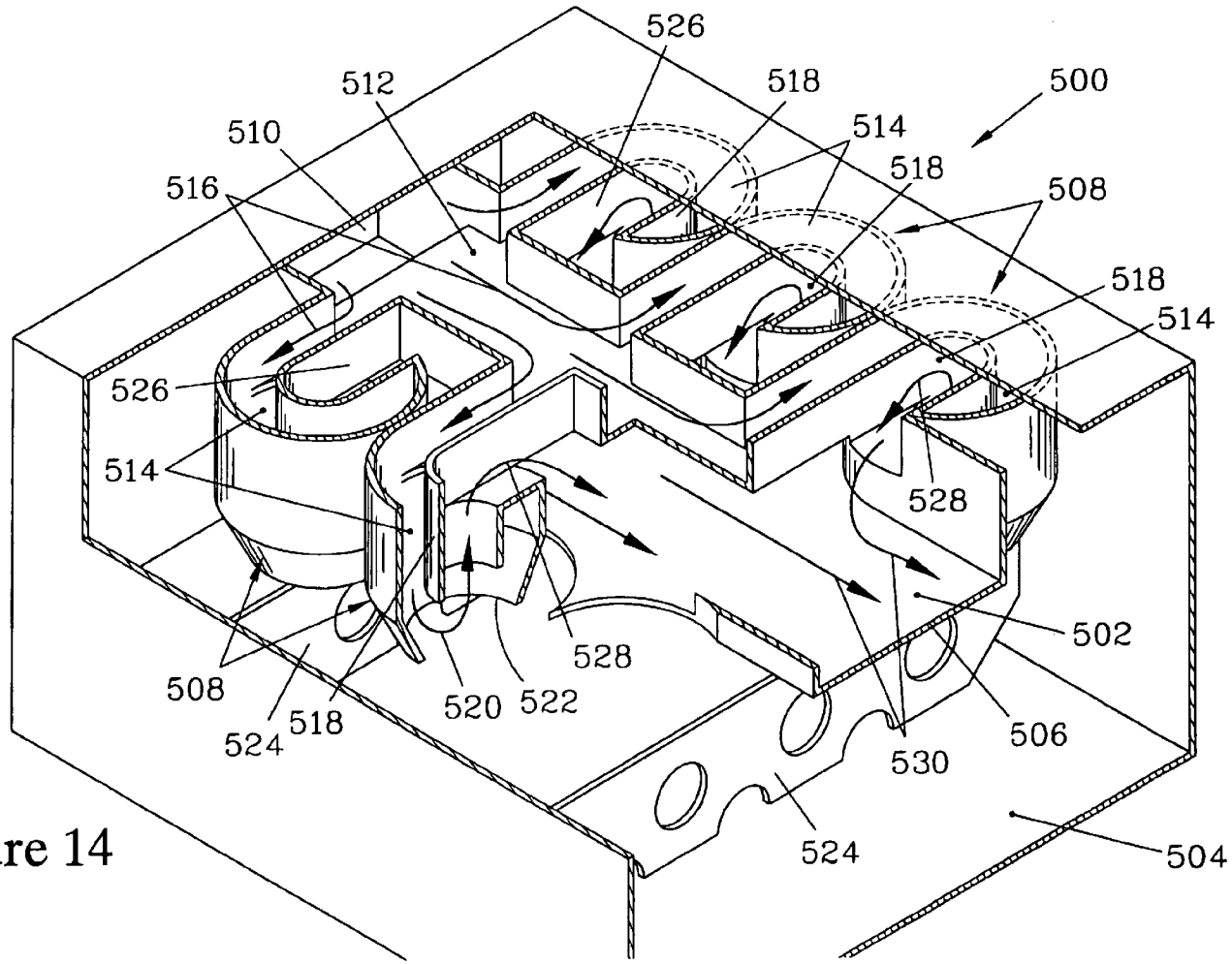
FIG. 14 is a partially sectioned isometric view of a collection chamber that could be employed for the gas processing system of the present invention. The collection chamber has several gas centrifuges that are nested with ducts to allow the gas centrifuges to be mounted at the top of the collection chamber, reducing the overall height of the collection chamber.

FIG. 14 is an isometric view showing a portion of a collection chamber 500 which employs an alternative arrangement for separating an upper section 502 from a lower section 504 to provide a reduced overall height of the collection chamber 500. In the collection chamber 500, a partition 506 connects to an array of gas centrifuges 508 such that the gas centrifuges 508 serve to form part of the structure separating the upper section 502 from the lower section 504.

Each of the gas centrifuges 508 communicates with a chamber inlet 510 via a transport duct 512, which resides substantially in the upper section 502. In this embodiment, the gas centrifuges 508 are arranged in two rows, with the transport duct 512 formed between the rows. The transport duct 512 communicates with an outer region 514 of each of the gas centrifuges 508, as indicated by the arrows 516. After spiraling down in the outer region 514, the air flows through a central air passage 518, as indicated by the arrow 520, while liquid and particulate matter separated from the air flow can drain into the lower section 504 through a drain passage 522. Baffles 524 can be placed in the lower section 504 to avoid sloshing of any liquid contained therein. The central air passage 518 of each of the gas centrifuges 508 terminates at an outlet passage 526 that in turn communicates with the upper section 502, as indicated by the arrows 528. The upper section 502 carries the air under the transport duct 512 to a chamber outlet (not shown), as indicated by the arrows 530.

Figure 15:
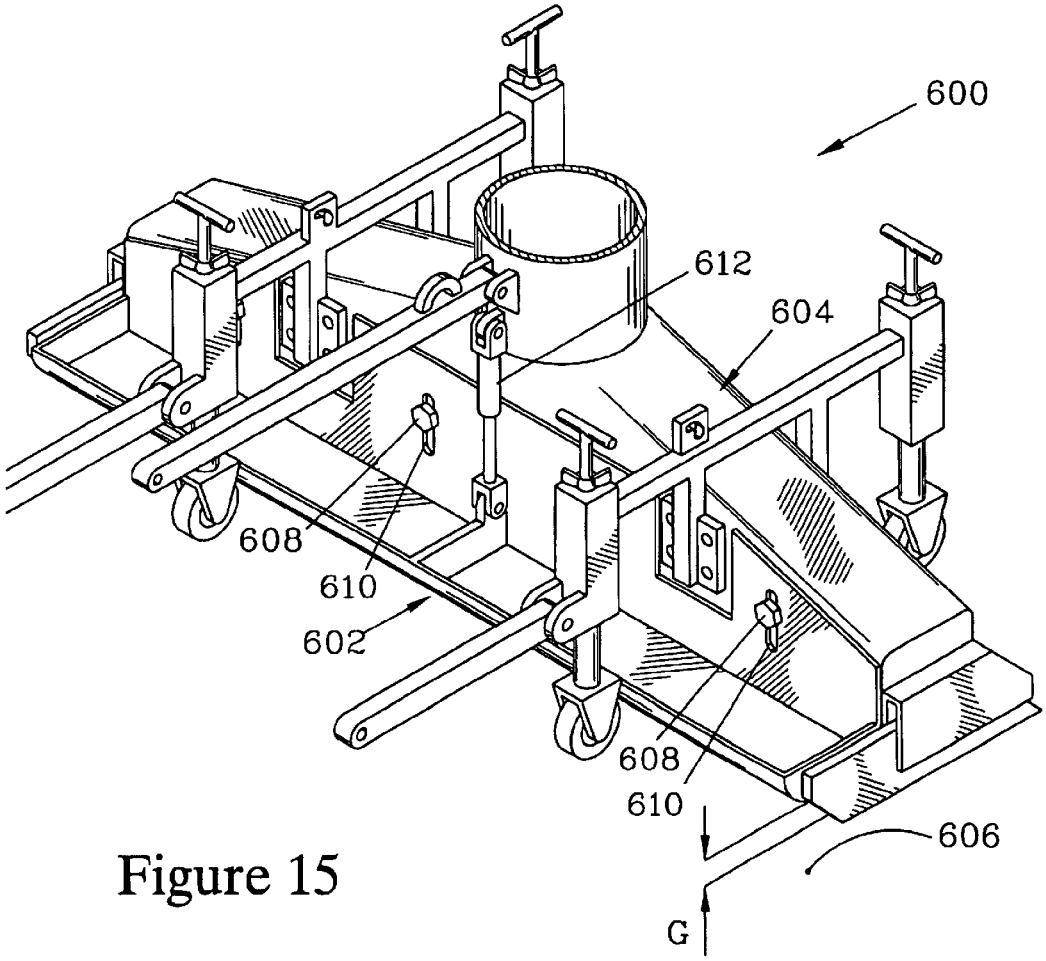
FIG. 15 is an isometric view of yet another embodiment of a pick-up assembly of the present invention, which has both forward and rear assembly wheels, and which differs from earlier embodiments in that it employs a nozzle damper that is slidably adjustable with respect to a nozzle body.

FIG. 15 illustrates yet another embodiment of the present invention, a pick-up assembly 600 for use with a gas processing system (not shown). The pick-up assembly 600 has a nozzle damper 602 that is formed as a plate that is slidably mounted to a nozzle body 604 to adjust the size of a controlled gap G between the nozzle damper 602 and a paved surface 606. The nozzle damper 602 is slidably mounted to the nozzle body 604 by damper bolts 608 which attach to the nozzle body 604 and slidably engage damper bolt slots 610 in the nozzle damper 602. Means for adjusting the size of the controlled gap G are provided by an actuator 612 that attaches between the nozzle damper 602 and a portion of the nozzle body 604. For strength and rigidity, the nozzle body 604 is preferably formed of welded sheet metal, such as steel or aluminum, or is formed of cast metal.

While the novel features of the present invention have been described in terms of particular embodiments and preferred applications, it should be appreciated by one skilled in the art that substitution of materials and modification of details obviously can be made without departing from the spirit of the invention.

What I claim is:

1. A pavement dryer for removing water from a paved surface, the pavement dryer comprising:

a gas processing system having, a system frame mounted on transporting wheels to allow said system frame to traverse the paved surface, a compressor mounted on said system frame and driven by an engine, said compressor having a compressor intake port and a compressor exhaust port, and a collection chamber mounted on said system frame, said collection chamber having a chamber inlet and a chamber outlet, said chamber outlet communicating with said compressor intake port;

a pick-up assembly having, an assembly frame, means for adjustably connecting said assembly frame with respect to said system frame, a nozzle supported by said assembly frame and having an elongated nozzle body having a nozzle opening bounded by a nozzle leading edge, a nozzle trailing edge, and a pair of end caps, a trailing edge seal resiliently mounted with respect to said nozzle trailing edge so as to forcibly engage the paved surface when said nozzle body is in close proximity to the paved surface, a nozzle lip traversing said nozzle leading edge, said nozzle lip being configured to provide a controlled gap between the paved surface and said nozzle leading edge, and a pair of assembly wheels providing support for said assembly frame and said nozzle with respect to the paved surface; and a nozzle conduit connecting said chamber inlet and said nozzle providing communication therebetween.

2. The pavement dryer of claim 1 further comprising:

means for adjusting the size of said controlled gap.

3. The pavement dryer of claim 2 wherein said assembly wheels are adjustably mounted with respect to said assembly frame, further wherein said pick-up assembly further comprises:

end seals mounted to said end caps and extending towards the paved surface.

4. The pavement dryer of claim 2 wherein said nozzle lip is a nozzle damper and said means for adjusting the size of said controlled gap is provided at least in part by adjusting the position of said nozzle damper with respect to said nozzle body.

5. The pavement dryer of claim 4 wherein said nozzle damper has a damper leading edge and a damper trailing edge, said damper trailing edge being pivotably mounted to said nozzle leading edge, said nozzle damper being configured to provide a convex surface for facing the paved surface.

6. The pavement dryer of claim 5 further comprising;

a nozzle damper control system for adjusting the separation of said convex surface from the paved surface to adjust the size of said controlled gap.

7. The pavement dryer of claim 2 wherein said pair of assembly wheels resides between said nozzle and said system frame.

8. The pavement dryer of claim 7 further comprising:

a second pair of assembly wheels positioned such that said nozzle resides between said pair of assembly wheels and said second pair of assembly wheels.

9. The pavement dryer of claim 8 wherein said assembly wheels are each rotatably mounted to said assembly frame so as to rotate about an axis normal to the paved surface.

10. The pavement dryer of claim 1 wherein said means for adjustably connecting said assembly frame with respect to said system frame further comprises:

a pivotable connection.

11. The pavement dryer of claim 10 wherein said pivotable connection limits motion of said assembly frame so as to substantially track said system frame.

12. The pavement dryer of claim 11 wherein said means for adjustably connecting said assembly frame with respect to said system frame further comprises:

a pair of parallel tow bars that pivotably attach to said assembly frame at about the level of said assembly wheels and pivotably connect to said system frame; and a stabilizing bar that is substantially parallel to said pair of tow bars and pivotably connects to said system frame.

13. The pavement dryer of claim 1 wherein said collection chamber is a bifurcated chamber comprising:

a partition dividing said chamber into an upper section and a lower section, said partition having one or more passages therethrough.

14. The pavement dryer of claim 13 wherein said collection chamber further comprises:

at least one gas centrifuge for separating particulate and liquid components from air passing therethrough, said at least one gas centrifuge attaching to said partition, each of said at least one gas centrifuges having an air inlet port, a central passage having a free end, and a particulate drain opening, said at least one gas centrifuge being so mounted that said free end of said central passage opens into said upper section of said collection chamber, thereby providing a passage through said partition; and a transport duct connecting said chamber inlet with said air inlet port of each of said at least one gas centrifuges.

15. The pavement dryer of claim 14 further comprising:

means for removing collected liquid and particulate matter from said lower section of said collection chamber.

16. A pick-up assembly for use in combination with a gas processing system having a system frame mounted on transporting wheels for traversing a paved surface and a collection chamber having a chamber inlet through which air is drawn into the collection chamber, the pick-up assembly comprising:

an assembly frame;

a pair of assembly wheels mounted with respect to said assembly frame to support said assembly frame with respect to the paved surface;

means for adjustably connecting said assembly frame with respect to the system frame;

a nozzle supported on said assembly frame for communicating with the chamber inlet, said nozzle having an elongated nozzle body having a nozzle opening bounded by a nozzle leading edge, a nozzle trailing edge, and a pair of end caps;

a trailing edge seal resiliently mounted with respect to said nozzle trailing edge so as to forcibly engage the paved surface when said nozzle body is in close proximity to the paved surface; and a nozzle lip traversing said nozzle leading edge, said nozzle lip being configured to provide a controlled gap between the paved surface and said nozzle leading edge.

17. The pick-up assembly of claim 16 further comprising:

means for adjusting the size of said controlled gap.

18. The pick-up assembly of claim 17 further comprising:

a second pair of assembly wheels positioned such that said nozzle resides between said pair of assembly wheels and said second pair of assembly wheels.

19. The pick-up assembly of claim 18 wherein said assembly wheels are each rotatably mounted to said assembly frame so as to rotate about an axis normal to the paved surface.

20. The pavement dryer of claim 17 wherein said nozzle lip is a nozzle damper having a damper leading edge and a damper trailing edge that is pivotably mounted to said nozzle leading edge, said nozzle damper being configured to provide a convex surface for facing the paved surface, further wherein said means for adjusting the size of said controlled gap is provided at least in part by adjusting the position of said nozzle damper with respect to said nozzle body.

* * * * *